United States Patent [19]

Montgomery, Sr.

[11] Patent Number: 5,044,570

[45] Date of Patent: Sep. 3, 1991

[54] SHAVER ROTOR ASSEMBLY

[75] Inventor: Robert C. Montgomery, Sr., Jacksonville, Fla.

[73] Assignee: Montgomery Industries International Inc., Jacksonville, Fla.

[21] Appl. No.: 520,739

[22] Filed: May 9, 1990

[51] Int. Cl.[5] ..... B02C 18/18

[52] U.S. Cl. ..... 241/294; 144/230; 241/300

[58] Field of Search ..... 407/46, 49, 51, 47; 144/172, 230, 174; 241/300, 293, 294, 242, 280, 292.1

[56] References Cited

U.S. PATENT DOCUMENTS

| | | | |
|---|---|---|---|
| 1,190,197 | 7/1916 | Shimer | 144/230 |
| 1,203,901 | 11/1916 | Newhouse | 241/294 |
| 1,756,986 | 5/1930 | Miller | 241/294 X |
| 3,037,540 | 6/1962 | Bloomquist et al. | 241/294 X |
| 3,134,412 | 5/1964 | Schmitt | 144/230 |
| 3,785,417 | 1/1974 | Vora | 144/230 X |
| 4,303,113 | 12/1981 | Andersson | 144/230 |
| 4,360,168 | 11/1982 | Peterson | 241/294 |
| 4,658,875 | 4/1987 | Grabovac | 144/230 |
| 4,819,703 | 4/1989 | Rice et al. | 144/230 |

FOREIGN PATENT DOCUMENTS

| | | | |
|---|---|---|---|
| 163710 | 6/1958 | Sweden | 241/294 |

*Primary Examiner*—Mark Rosenbaum

*Attorney, Agent, or Firm*—Nies, Kurz, Bergert & Tamburro

[57] ABSTRACT

A rotor assembly for a shavings making machine having a plurality of knife and wedge assemblies is disclosed. The knife and wedge assemblies are removably mounted in channels or pockets extending parallel to the rotor axis along the length of the circumference of the rotor. In mounting each knife and wedge assembly to the rotor, the knife insert is first mounted on the respective wedge insert and the wedge insert is then mounted on the rotor. The bolts or other means for mounting each knife insert on the wedge insert are located below the periphery of the rotor and adjacent one side wall of the respective channel such that the bolts cannot back out or become loosened due to vibrational forces. Each knife insert has two reversible blades which are symmetrical. A flattened surface on the rotor adjacent each knife insert assists in providing an effective cutting operation. The metallurgical composition of the knife inserts can be varied to accommodate the material in a particular application.

9 Claims, 2 Drawing Sheets

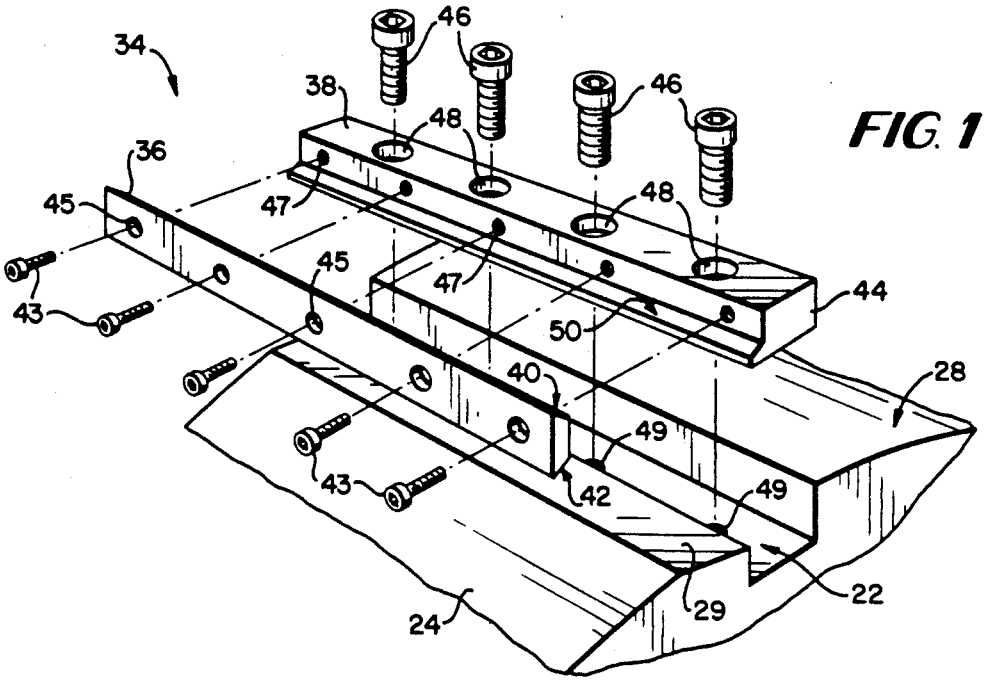
FIG. 1
FIG. 2
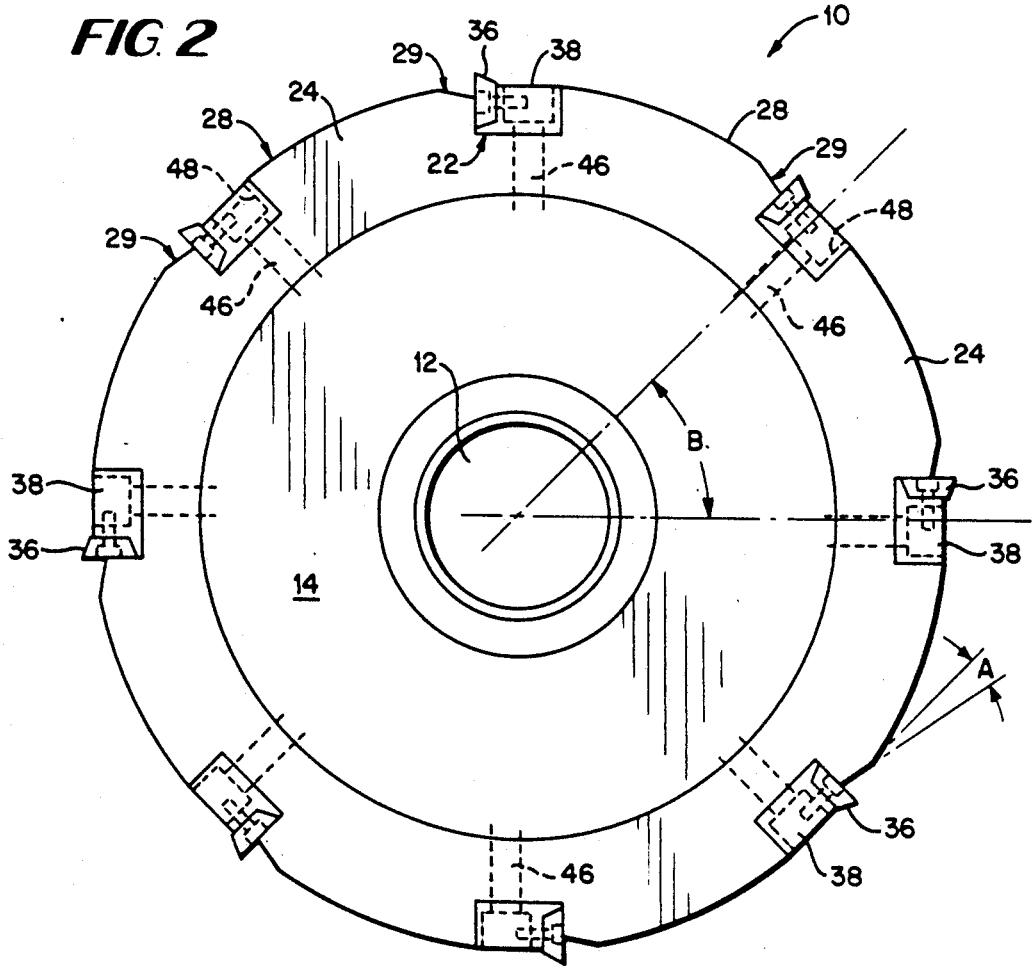

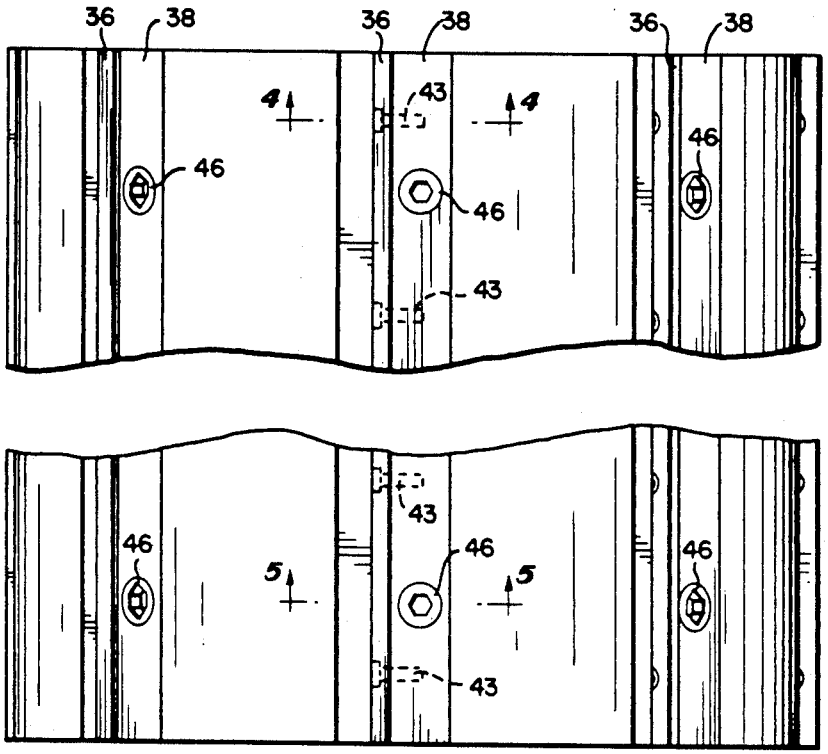
FIG. 3
FIG. 4
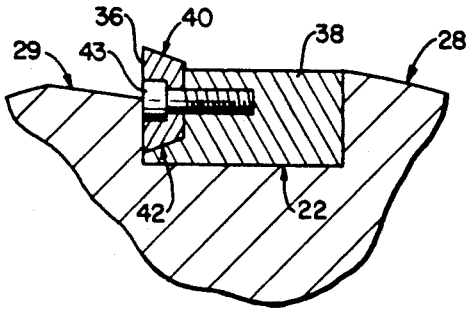
FIG. 5
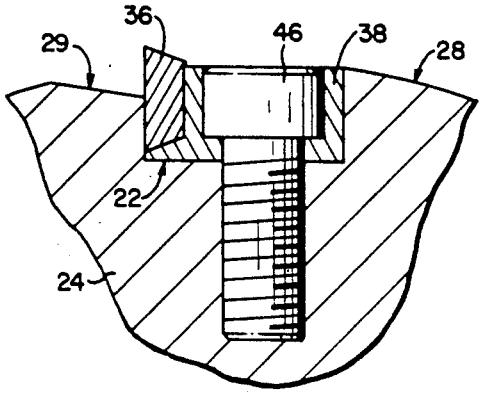

SHAVER ROTOR ASSEMBLY

The present invention relates to a machine for converting random size and shape pieces of wood, plastic and other materials into relatively uniform thickness shavings.

The invention may be advantageously used for example in a woodworking shop where scrap wood pieces of random size and shape accumulate and present a disposal problem. This problem can be solved to profitable advantage by converting the scrap to fluffy shavings which can be sold for use in cattle bedding for dairy farms, chicken litter for chicken farms, mulch for mixture with fertilizer and the like.

The invention may be incorporated in the machine disclosed in U.S. Pat. No. 3,679,143 and is an improvement of the rotor assembly disclosed in U.S. Pat. No. 3,866,844.

While the rotor assemblies described in the above patents perform very well under many conditions, there has been some difficulty in maintaining a sharp edge on the cutting knives employed in the rotors, and it is a major object of this invention to provide a novel rotary cutter assembly that will solve the foregoing problem.

A further object of the invention is to provide in a wood or like reducing machine a rotary cutter assembly wherein a plurality of longitudinal rows of relatively short knife blades in the form of reversible symmetrical inserts which provide a pair of cutting edges for each knife blade position are mounted on a rotor periphery, the rows being preferably identical and equally spaced circumferentially.

Another object of the invention is to provide in a rotary cutter a plurality of longitudinal rows of reversible knife blades which are symmetrical in two planes, creating a reversible insert that provides two cutting edges instead of one to reduce maintenance costs on the machine.

A further object of the invention is to provide a novel knife blade spacing and clamping element for mounting in the periphery of a rotor cutter in which a knife insert is employed in combination with a wedge insert which allows the wedge insert to be bolted to the rotor such that the bolts holding the knives to the wedge insert cannot back out or become loosened due to vibrational forces.

Another object of the invention is to provide a novel knife blade insert adapted for adjustable mounting in a longitudinal cutter assembly row of a rotary cutter, wherein the metallurgical composition of the insert can be varied to accommodate the material in a particular application.

A further object of the invention is to allow the entire wedge and knife assembly to be removed from the wood shaver pocket and replaced with a new wedge and knife assembly to minimize downtime on the machine when the cutting edges become worn, with the removed knife-wedge assembly being resharpened or replaced without having the machine waiting idle.

BRIEF DESCRIPTION OF THE DRAWINGS

FIG. 1 is a partial perspective in an exploded view showing a rotary cutter assembly of the present invention.

FIG. 2 is an end elevation partly broken away and in section showing further details of the rotary cutter assembly of FIG. 1.

FIG. 3 is a fragmentary side elevation showing details of the knife and wedge assemblies mounted on the rotor.

FIG. 4 is a partial cross section taken along line 4—4 of FIG. 3.

FIG. 5 is a partial cross section taken along line 5—5 of FIG. 3.

DESCRIPTION OF THE PREFERRED EMBODIMENTS

In the embodiment of the invention as shown in FIGS. 1 through 5, there is provided a rotor assembly which includes a central shaft 12 on which is fixed a central portion 14 non-rotatably secured to the shaft 12. The interior of the rotor assembly 10 may be generally in the form as described in U.S. Pat. No. 3,866,844 which is incorporated herein by reference.

A series of blade mounting channels or pockets 22 are machined or otherwise formed in the outer periphery of the rotor. Channel members 22 are parallel on the rotor periphery and equally spaced circumferentially and they extend parallel to the rotor axis. Between adjacent channel members 22 there are located arcuate peripheral sections 24 of the rotor. The outer cylindrically curved surfaces 28 of the rotor sections 24 lie in a cylindrical envelope, the center of which is the axis of shaft 12. These surfaces 28 are formed with a flat indented surface 29 adjacent each channel 22 in the direction of rotation, as shown in FIGS. 1 and 2. Each indented surface 29 provides a small chip pocket as a place for the shaved wood to go as it comes off the blade and thereby assists in allowing the knife to cut more effectively. Each surface 29 forms an angle A of about 5 to 15 degrees with a tangent to the circumference of the rotor as shown in FIG. 2. In one embodiment of the invention, an angle A of 11 degrees was employed.

The foregoing provides a cylindrical rotor assembly having on its peripheral surface a series of rigid parallel channel members extending the length of the rotor. Each channel member 22 is centrally formed with a recessed channel that is of uniform size from end to end and is open at opposite ends. The illustrated construction has eight channel members equally spaced on the rotor circumference at an angle B of about 45 degrees. However, the actual number of the channel members is not critical.

A knife and wedge assembly 34 which includes a knife insert 36 and a wedge insert 38 is mounted in each channel member 22, with the outer cutting edges of each knife 36 projecting out of the cylindrical periphery of the rotor. Each knife insert 36 is a generally flat sided bar as shown, being tapered at the upper and lower edges in cross section to provide reversible upper 40 and lower 42 planar cutting edges. The rake angle of the upper 40 and lower 42 cutting edges may be in a range of about 5 to 45 degrees. In one embodiment, a rake angle of 20 degrees was employed with good results.

It is important that the knife inserts 36 be symmetrical with regard to the upper 40 and lower 42 planes so that two equally effective cutting surfaces are provided, allowing a new cutting surface to be obtained simply by reinstalling a knife insert 36 with the upper 40 and lower 42 surfaces reversed.

Thus there are provided a pair of cutting edges on each knife insert to reduce maintenance costs on the machine. The metallurgical composition of the knife inserts can be varied to accommodate the material in a particular application. Thus, for example, the knife inserts 36 may be formed of mild steel or tool steel. As an example, a 10 to 20 percent carbon mild steel or an A-2 tool steel may be employed.

In the case of mild steel, the cutting edges may be built up with one or more welding alloys to provide wear resistance and extend the knife life. For example a Stoody welding alloy such as a No. 121, No. 133 or No. 8442 alloy may be employed. Where tool steels are employed, these materials provide the desired properties of impact strength and wear resistance. Many variations of tool steel are possible and the one selected for a particular application will generally depend on the characteristics of the wood being fed to the rotor, including wood species, sand content, amount of bark and the like.

Each knife insert 36 is secured to the respective wedge insert 38 by a plurality of bolts 43 mounted in holes 45 in the knife insert 36 and extending into holes 4 in the wedge insert 38.

Each wedge insert 38 is an elongated bar which is generally rectangular in cross section and has an outwardly extending flange 44 along one side which is tapered in cross section at its upper edge 50 to coincide with the tapered lower edge 42 of the respective knife insert 36. A plurality of bolts 46 are employed at intervals along the length of each wedge insert 38 to secure the wedge inserts 38 to the rotor. The bolts 46 are mounted in holes 48 in the wedge inserts 38 so that the heads of the bolts 46 are located flush with the top surfaces of the wedge inserts 38, as shown in FIG. 5. The lower ends of the bolts 46 are secured in holes 49 in the lower surface of each channel 22.

In mounting each knife and wedge assembly 34 to the rotor, the knife insert 36 is first bolted to the respective wedge insert 38. The wedge insert 38 is then bolted to the rotor. As can be seen from the drawings, the bolts 43 holding the knife inserts 36 to the wedge inserts 38 are below the surface of the rotor and thus cannot back out from vibrational forces.

In the operation of the present rotor assembly 10, the rotor may be operated in a conventional manner such as described in U.S. Pat. No. 3,866,844. The construction and location of the knife and wedge assemblies 34 of the invention as described herein result in an improved cutting operation. In addition, the presence of the flattened surface 29 adjacent each knife insert 36 allows the blades to cut more efficiently. In order to reverse the position of a knife insert 36 so as to utilize the second cutting surface, it is only necessary to remove the bolts 43 and 46 of an individual assembly 34, after which the knife insert 36 may be turned bottom side up and repositioned adjacent the wedge insert 38, with the bolts 43 and 46 then being reinstalled.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A rotor assembly for a shavings making machine comprising:

a rotor having an external periphery;

a plurality of circumferentially spaced longitudinally extending parallel channels in said rotor periphery;

a wedge insert mounted in each channel, at least one of said wedge inserts having a lower portion which is approximately equal to the width of the respective channel and with said at least one wedge insert extending approximately the length of the respective channel;

a knife insert for mounting on said at least one wedge insert, said knife insert having a pair of cutting edges which are symmetrical in two planes, thus providing a reversible insert with two cutting edges; and means for removably mounting said knife insert on said at least one wedge insert;

said knife insert having a vertical exterior surface which abuts a side wall of the respective channel, said mounting means extending only from said vertical exterior surface inwardly through said knife insert and said at least one wedge insert, and wherein said mounting means abuts said side wall and thus cannot back out of the knife insert due to vibrational forces.

2. The rotor assembly of claim 1 wherein said knife insert is tapered in cross section to provide an angled surface which mates with a corresponding surface of said at least one wedge insert.

3. The rotor assembly of claim 2 wherein the angled surface has angle of about 5 to 45 degrees.

4. The rotor assembly of claim 1 wherein the periphery of said rotor has a flat surface along the length thereof inclined toward said channel on the side of said channel adjacent said knife insert.

5. The rotor assembly of claim 4 wherein the angle of inclination of said flat surface with a tangent to the circumference of the rotor is about 5 to 15 degrees.

6. The rotor assembly of claim 1 wherein the cutting edge of said knife insert is formed of tool steel.

7. The rotor assembly of claim 1 wherein said at least one wedge insert is mounted in the respective channel by a plurality of bolts extending radially within said rotor.

8. The rotor assembly of claim 7 wherein said means for removably mounting said knife insert includes a plurality of bolts extending perpendicular to the bolts which mount said at least one wedge insert in the respective channel.

9. The rotor assembly of claim 1 wherein the cutting edge of said knife insert is formed of mild steel with hardfacing on wear areas.

* * * * *